US006175614B1

(12) United States Patent
Jensen et al.

(10) Patent No.: US 6,175,614 B1
(45) Date of Patent: Jan. 16, 2001

(54) METHOD AND APPARATUS FOR AUTOMATIC SIZING AND POSITIONING OF ABS SAMPLING WINDOW IN AN X-RAY IMAGING SYSTEM

(75) Inventors: Vernon T. Jensen, Drapher; R. Larry Anderton, West Jordan; Barry K. Hanover, Salt Lake City, all of UT (US)

(73) Assignee: OEC Medical Systems, Inc., Salt Lake City, UT (US)

( * ) Notice: Under 35 U.S.C. 154(b), the term of this patent shall be extended for 0 days.

(21) Appl. No.: 09/306,908

(22) Filed: May 7, 1999

(51) Int. Cl.[7] ..... H05G 1/64
(52) U.S. Cl. ..... 378/98.7; 378/95
(58) Field of Search ..... 378/95, 98.7

(56) References Cited

U.S. PATENT DOCUMENTS

| | | | |
|---|---|---|---|
| 4,573,183 | 2/1986 | Relihan | 378/108 |
| 5,003,572 | 3/1991 | Meccariello et al. | 378/98.7 |
| 5,675,624 | 10/1997 | Relihan et al. | 378/98.7 |

*Primary Examiner*—David P. Porta
*Assistant Examiner*—Allen C.e Ho
(74) *Attorney, Agent, or Firm*—Thorpe, North & Western, LLP

(57) ABSTRACT

A method for providing automatic brightness control in a closed loop x-ray imaging system which utilizes an automatic brightness system (ABS) sampling window. The location, size and shape of the ABS sampling window is adjusted in accordance with statistical information including spatial gray scale distribution data derived from the data related to the x-ray system and image being processed, thereby enabling the automatic brightness control to make brightness and power adjustments in accordance with statistical data from the modified ABS sampling window.

27 Claims, 8 Drawing Sheets

Form2

| OffsetX | = | ROISize/2 | | ROISize | | Q(2)Percent GrayScale | | Q(4)Percent GrayScale | |
|---|---|---|---|---|---|---|---|---|---|
| -42 | = | 309 | /2 | 309 | ( | 0.243 | + | 0.393 | ) |

| OffsetY | = | ROISize/2 | | ROISize | | Q(2)Percent GrayScale | | Q(4)Percent GrayScale | |
|---|---|---|---|---|---|---|---|---|---|
| -39 | = | 309 | /2 | 309 | ( | 0.235 | + | 0.393 | ) |

where Q( ) Percent GrayScale = Q( )Average / SumQ Averages

| | | | | | |
|---|---|---|---|---|---|
| For Q(1) | 0.130 | = | 56.93 | / | 439.6 |
| For Q(2) | 0.243 | = | 106.80 | / | 439.6 |
| For Q(3) | 0.235 | = | 103.22 | / | 439.6 |
| For Q(4) | 0.393 | = | 172.65 | / | 439.6 |

*Fig. 10*

METHOD AND APPARATUS FOR AUTOMATIC SIZING AND POSITIONING OF ABS SAMPLING WINDOW IN AN X-RAY IMAGING SYSTEM

BACKGROUND

1. The Field of the Invention

This invention relates generally to x-ray imaging apparatus. More specifically, the invention relates to automatic brightness control in a closed loop imaging system which uses an automatic brightness control sampling window.

2. The State of the Art

X-ray imaging systems are well known medical diagnostic and interventional tools. X-rays are generated when a high voltage generator supplies electric power to an x-ray tube. One circuit prepares the tube for x-ray exposure by heating the tube filament. A second circuit generates a high voltage potential that accelerates x-rays from the filament (or cathode) to the anode within the x-ray tube.

The filament in the x-ray tube is a coiled tungsten wire that, when heated by current flow, emits electrons. This is a low voltage circuit. Relatively little power is needed to heat the filament, and small variations in filament current result in large variations in x-ray tube current.

Electrons emitted from the filament are focused onto a spot in the tungsten target (anode). X-ray photons are produced when the electrons interact, by sudden deceleration, within the tungsten anode. The target surface is angled to reflect the x-rays in the direction of the x-ray tube output window.

In order to understand the relationship between the high voltage generator control and its effects on x-ray beam penetration, and subsequently, diagnostic image quality, it is important to remember that the intensity of an x-ray beam varies with the electrical potential in kilovolts (kVp) and the tube current (mA) applied to the tube. The quality and intensity of the x-ray photons generated depends almost entirely on the kVp.

Because exposure to radiation is harmful, all practical methods are employed to reduce x-ray exposure to patients. One method is to collimate the x-ray beam with materials that will partially or completely absorb x-rays. Proper beam collimation also assists the video imaging system by prohibiting non-attenuated (unimpeded) x-ray photons from reaching an image intensifier.

Varying clinical procedures have unique beam collimation requirements. The most common systems employ a combination of fixed, adjustable leaf, and adjustable iris collimation. Systems can also use a combination iris and leaf collimator with independent motorized controls and position feedback.

During the examination of a patient, an image is produced when x-ray photons pass through the patient and are then converted to light photons through the use of an image intensifier tube or some other x-ray conversion device. The x-ray photons pass through tissue and materials of varying mass and composition before striking the input surface of the image intensifier. X-rays will either penetrate or be absorbed by whatever lies in the path of the X-ray beam. As x-rays strike the input screen in the image intensifier, x-ray photons are converted into light photons. Within the photocathode the light photons are converted to electrons and focused by an electrostatic lens onto an output phosphor. The output phosphor once again converts the electrons to light photons where the image is visible at the output window of the image intensifier tube.

At this stage, calculating the actual sizes or dimensions of objects in the image requires knowing: 1) the image intensifier size, 2) the image intensifier electrostatic lens magnification, and 3) the magnification of the object due to its distance from the surface of the image intensifying tube.

A video camera captures the image as it is displayed at the output of the image intensifier. The automatic brightness system (ABS) control application dynamically determines the camera gain, kVp and mA, based on the image brightness statistics. Peak brightness and average brightness of the area within the ABS sampling window are used as the conventional factors in setting the ABS control parameters (kVp, mA and camera gain). It should also be mentioned that the image intensifier might also be some other type of image receptor such as a flat panel x-ray image receptor or some other scanned image x-ray receptor.

As a patient is re-positioned beneath the x-ray beam during an examination, the brightness of the video image changes because of variations in the attenuation of the x-ray beam as it passes through different thicknesses and densities of body tissue and bone. In order to compensate for these variations in image brightness, various automatic brightness compensation systems have been devised.

For example, in U.S. Pat. No. 4,573,183, the automatic brightness control derives the average brightness of the image from the video signal. That average brightness information is used to produce a video gain signal for controlling the camera and to generate a brightness feedback signal that controls an x-ray tube power supply. In response to the brightness feedback signal, the x-ray tube power supply generates a bias voltage and filament current for the x-ray tube to thereby regulate brightness of the x-ray image formed by the image intensifier tube. By varying the gain or the aperture of the video camera, the resulting image brightness on the monitor also is controlled. Accordingly, the feedback provided to the automatic brightness control modifies the x-ray emission and camera gain which affects the image brightness. The feedback control can be calibrated to generate consistent image display brightness regardless of changes in patient x-ray absorption. The standard automatic brightness control derives the video gain and brightness feedback signals from a common average brightness value, a peak brightness, or a combination of the values for the image. However, a common brightness feedback signal results in less than ideal control of these system parameters which affect the image generated on the monitor.

Another example of the state of the art is taught in U.S. Pat. No. 4,703,496. This patent apparently teaches that luminances of picture elements in each video image field were averaged to generate a signal having a voltage proportional to the average image brightness.

The average brightness value is used as a feedback signal to control the excitation of the x-ray tube and the video gain to thereby maintain the video image brightness substantially constant at an optimum level. However, the system is relatively complex in that it utilizes three separate loops for regulating tube current, bias voltage and video gain.

The systems described are complex and are difficult to maintain. Accordingly, it would be an advantage over the state of the art to provide an automatic brightness control system which is simpler to operate, and is able to compensate for the effects of improper patient positioning, variations in patient size, and rapid changes from torso to extremity imaging.

OBJECTS AND SUMMARY OF THE INVENTION

It is an object of the present invention to provide a method for automatic brightness system (ABS) control in a closed loop imaging system.

It is another object to provide a method for an ABS which utilizes a sampling window to define the boundaries of an ABS sampling area which can compensate for the situation when the maximum x-ray attenuation is not centered in the image.

It is another object to provide a method for an ABS which utilizes an ABS sampling window which can compensate for the situation when areas of non-attenuated x-ray photons are within the imaging area.

It is another object to provide a method for an ABS which utilizes an ABS sampling window wherein the location of the sampling window is adjustable as a function of the spatial gray scale distribution within an image.

It is yet another object to provide a method for an ABS which utilizes an ABS sampling window wherein the size of the sampling window is adjustable as a function of the image intensifier size, image intensifier magnification mode, and the kVp for an image.

It is a further object to provide a method for an ABS which utilizes an ABS sampling window wherein the shape of the sampling window is adjustable as a function of the A collimation.

It is another object to provide a method for an ABS wherein the method is implemented as a dynamic function within an image processing system to thereby provide optimum imaging despite improper patient positioning, variations in patient size, and rapid changes from torso to extremity imaging.

The presently preferred embodiment of the present invention is a method for providing automatic brightness control in a closed loop imaging system which utilizes an ABS sampling window. The location and geometry of the ABS sampling window is adjusted in accordance with statistical information derived from the data within an image region of interest.

In a first aspect of the invention, the ABS sampling window is moved as a function of the spatial gray scale distribution within the image.

In a second aspect of the invention, an image is divided into segments, wherein each segment is analyzed to determine the most useful sampling area for the ABS instead of the center of the image.

In a third aspect of the invention, the encroachment of collimation into the image is accounted for.

In a fourth aspect of the invention, the size of the ABS sampling window is adjusted in accordance with the kVp, and image intensifier size and magnification mode.

In a fifth aspect of the invention, the movement of the ABS sampling window is dampened by adding temporal averaging to the algorithm.

In a sixth aspect of the invention, threshold values are used for gray scale values to thereby limit the effect of extreme values on the algorithm.

These and other objects, features, advantages and alternative aspects of the present invention will become apparent to those skilled in the art from a consideration of the following detailed description taken in combination with the accompanying drawings.

BRIEF DESCRIPTION OF THE DRAWINGS

FIG. 10 is a result form showing the values that are substituted into equations 1, 2 and 3, and the resulting offsets X and Y.

DETAILED DESCRIPTION OF THE INVENTION

Reference will now be made to the drawings in which the various elements of the present invention will be given numerical designations and in which the invention will be discussed so as to enable one skilled in the art to make and use the invention. It is to be understood that the following description is only exemplary of the principles of the present invention, and should not be viewed as narrowing the claims which follow.

It is useful to have an overview of the present invention before the detailed description of the preferred embodiment is presented. Accordingly, it is observed that the present invention advantageously provides an automatic brightness system (ABS) that utilizes an ABS sampling window. The two properties which define an ABS sampling window within an image are: 1) the window position, and 2) the window geometry.

The position of the ABS sampling window is determined by comparing the average gray scale values of the image region of interest segments. The size of the ABS sampling window is adjusted based on the kVp and the image intensifier size and magnification values. Further, the shape of the ABS sampling window is also adjusted based on the collimation in the ABS sampling window.

The presently preferred embodiment of the invention provides for an ABS in a closed loop imaging system. The method provides a dynamic ABS function which operates on an ABS sampling window to thereby improve the imaging system's ability to provide optimum imaging. By automating the system, images are created which have better diagnostic information.

Figure 1:
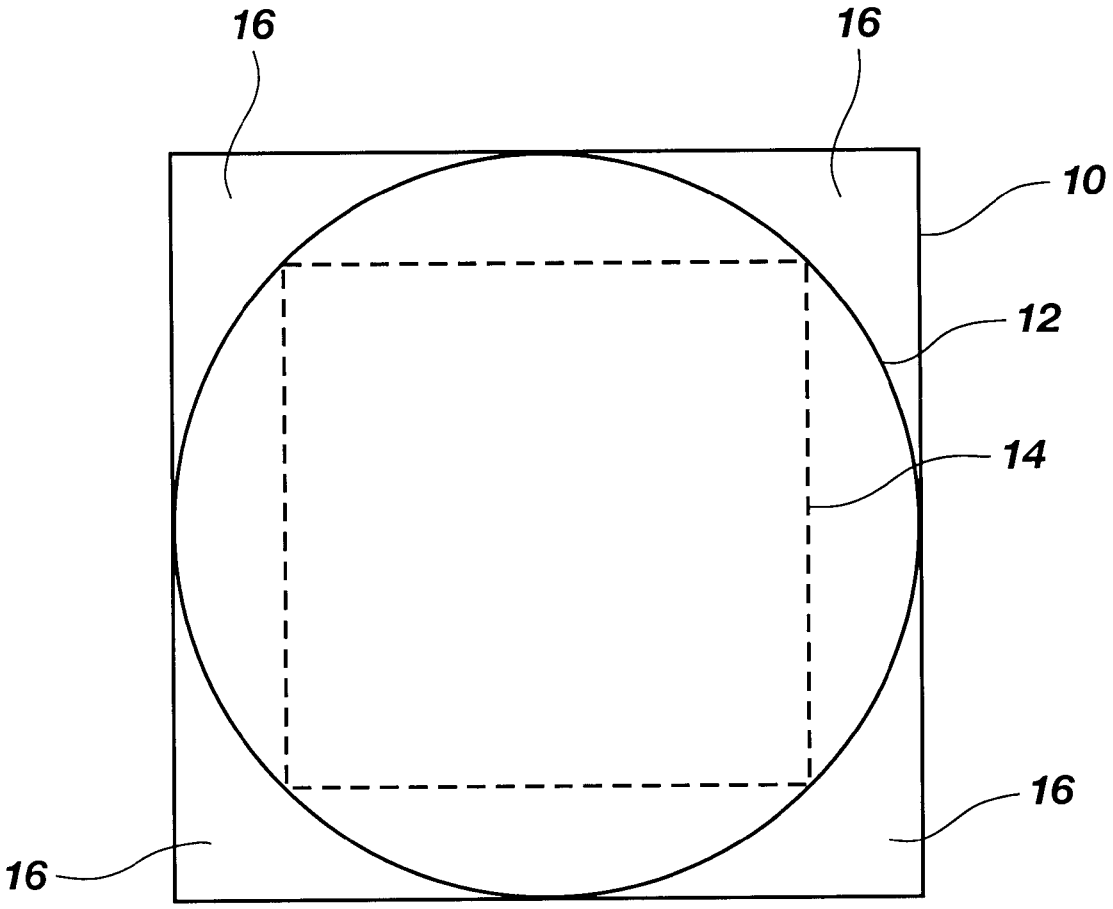
FIG. 1 is a front elevational view of an image, including a Region of Interest (ROI) which is established within a circular blanking area.

FIG. 1 is a front elevational view of a video image 10. A Region of Interest Size (ROISize) is established within a circular blanking area 12. In this figure, the ROI 14 is shown as a square region, but it could also be a circle or some other arbitrary geometric selection as will be explained later. The areas 16 outside of the circular blanking area 12 comprise information that is not relevant to the calculations to be performed. All useful information is shown within the circular blanking area 12. The ROISize defines a number of pixels which will be examined.

Certain characteristics about the image must be recognized to understand the method used in this invention for positioning and sizing the ABS window. First, the darker zones in the image represent the thickest or most dense anatomy in the image. A zone is defined here as an image area large enough to represent a significant anatomical attribute or feature.

It should be understood that the location of the darkest pixel in the image is not likely to be the optimum center position for the ABS sampling window because the darkest pixel may be a metal prosthesis or similar material. Furthermore, the gray scale composition of all unobstructed (non-collimated) image areas provide useful information for determining the ABS sample window position.

Figure 2:
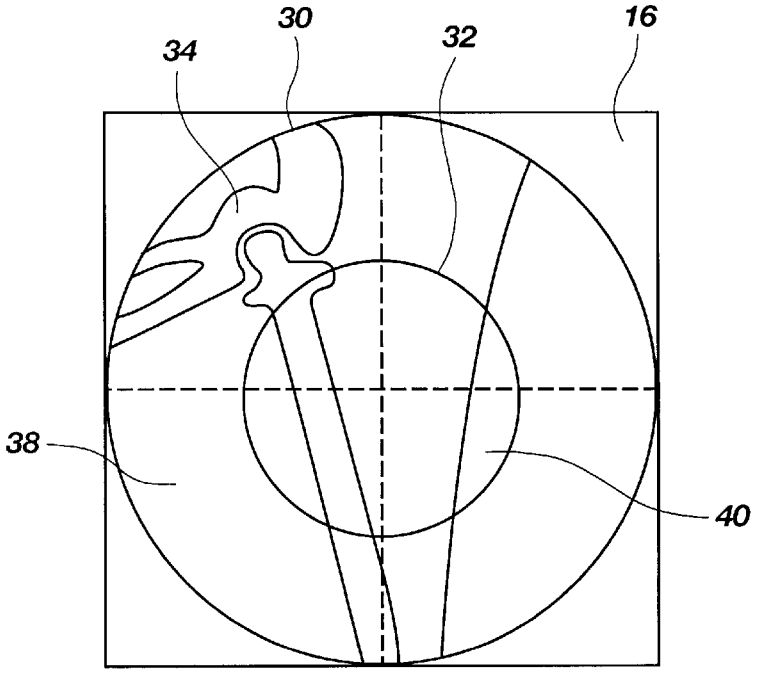
FIG. 2 shows a conventional ABS sampling window that is directly centered in the diagnostic x-ray image.

FIG. 2 represents a clinical x-ray image where the area of greatest anatomical density in a leg 38 being x-rayed (e.g. the hip joint 34) is not centered in the image 30. The ABS sampling window 32 also shown using the conventional method of centering the ABS sampling window 32 within the target image 30. The ABS sampling window in FIG. 2 also contains an area 40 with non-attenuated x-ray photons. Including non-attenuated x-ray photons in average or peak gray scale value calculations produces misleading output. As a result, the gain or kVp will not be raised to a high enough level because the ABS system will believe that the image is already bright enough.

Figure 3:
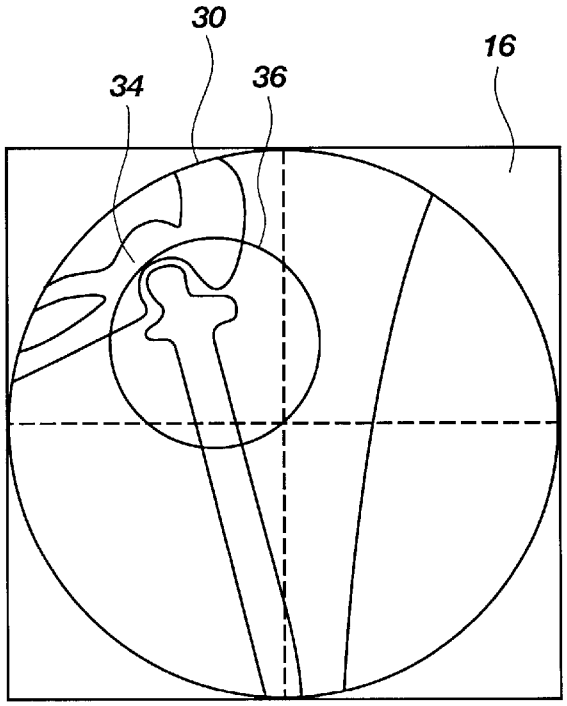
FIG. 3 shows the ABS sampling window after it has been moved and sized in accordance with the current invention.

FIG. 3 shows where the ABS sampling window 36 will be positioned using the method of the current invention. The image's gray scale range is optimized by centering the ABS sampling window 36 over the dense patient anatomy 34 in the image 30. It should be noted that the ABS sampling window 36 which is positioned according to the method of this invention avoids capturing non-attenuated x-ray photons. Repositioning and re-sizing the ABS window also captures an area of denser anatomy to assure that the correct kVp, mA, and gain are used to view the subject anatomy in the proper dynamic range. In other words, the anatomical image will not be overly dark because the area of non-attenuated x-ray photons is minimized as a result of re-positioning and a denser area of patient anatomy will be accounted for in determining the strength of the x-rays.

Figure 4:
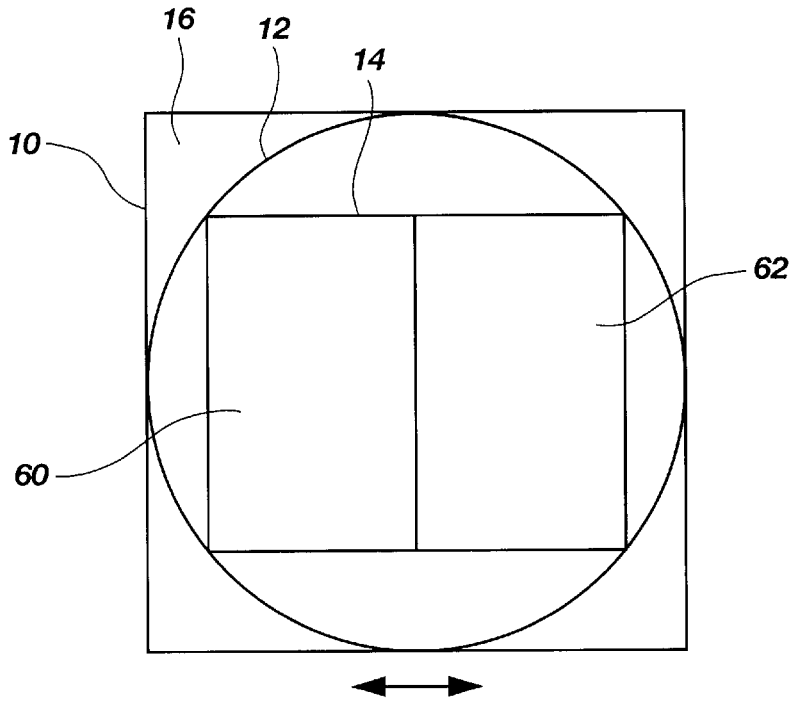
FIG. 4 shows a region of interest divided into two segments across the X coordinate axis.

Referring now to FIG. 4, the method used in the current invention for moving the ABS sampling window compares the average gray scale value on the left half 60 of the ABS sampling window 14 with the average gray scale value of the right half 62 to determine a horizontal (x-axis offset). It should also be apparent based on this disclosure that the left half or right half could be compared to the whole image 12, but it is more efficient to compare the halves of the-ABS sampling window. The previously blanked out areas 16 of the full image 10 are not considered.

Figure 5:
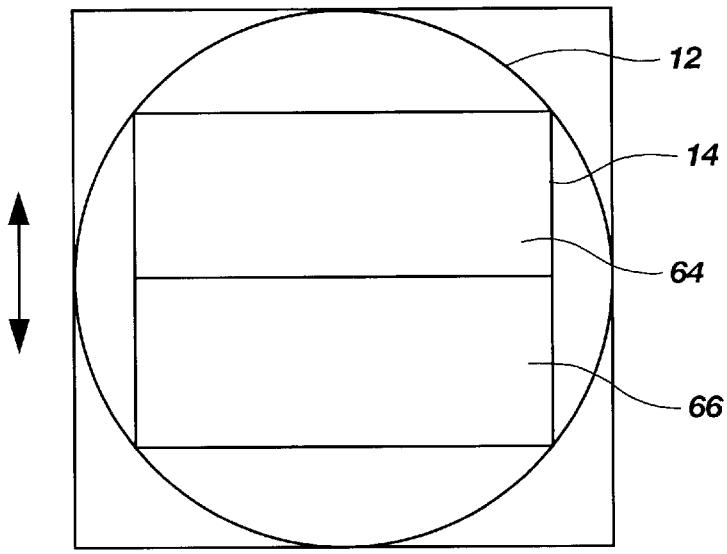
FIG. 5 shows a region of interest divided into two segments across the Y coordinate axis.

FIG. 5 shows that the same type of comparison is made between the top half 64 and bottom half 66 of the ABS sampling window 14 to determine the vertical (y-axis) offset.

Figure 6:
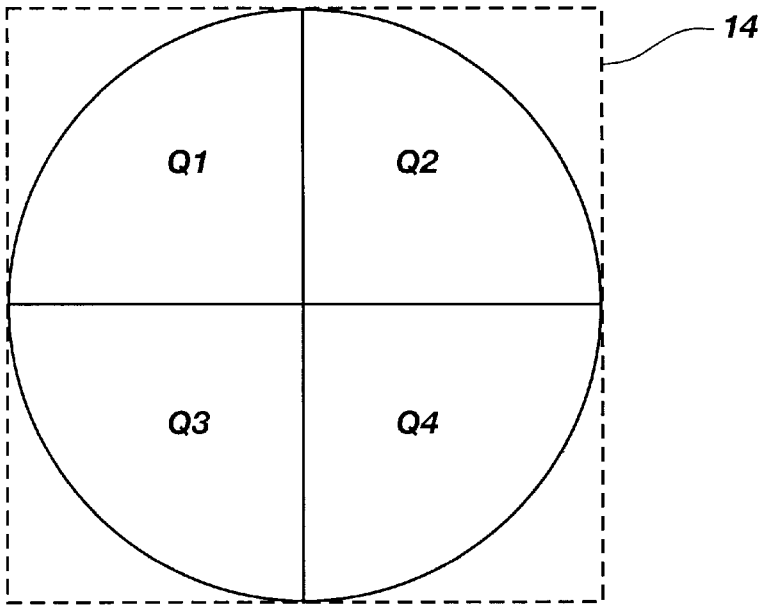
FIG. 6 is an elevational front view of the image of FIG. 1, wherein the ROI is now segmented.

For ease of description and implementation the method of the current invention computes the average gray scale for quadrants in the image, and then combines the appropriate quadrants to form a half which is then compared against the sum of the average gray scale of all the quadrants. In essence, this compares one half to the other half as described. FIG. 6 is an elevational front view of the image 10 of FIG. 1, wherein the image ROI 14 is segmented into quadrants. The segmented areas Q1, Q2, Q3 and Q4 define the regions from which statistical information is going to be taken for the ABS sampling window adjustments. It is important to note that the segment shape will be affected by clipping to correct for collimation. However, the number, location, and shape of the segments (or quadrants) may vary depending on the specific implementation.

While the segments Q1, Q2, Q3 and Q4 are shown as being contiguous in FIG. 6, the segments do not have to be touching. The segments can be spaced apart from each other, or even overlap. Comparing the average gray scale values of the four quadrants of the image provides enough information to make proportional position adjustments to the ABS sampling window. As previously mentioned, it is not necessary that each quadrant have the same shape or area. Comparing the gray scale average of each quadrant equalizes their statistical weight, regardless of the ratio of pixels sampled per quadrant.

After segmenting, the next step is to determine an average gray scale value for each segment of the image. The method for calculating the average gray scale value for any selectable portion of the image is known to those skilled in the art. For example, the gray scale values may vary between zero (0) which is equal to a completely black pixel, to 255 which is equal to a completely white pixel. A pixel that shows a non-attenuated x-ray beam because there is no patient tissue, bone or other material obstruction will generally be assigned the gray scale value of 255. In contrast, when an x-ray photon is unable to pass through an object, the pixel will generally be assigned a value of zero. Accordingly, the pixels that show tissue, bone or other materials that have at least been penetrated by some of the x-ray photons will be assigned a value on an absolute scale extending from 0 to 255. It should be apparent that one skilled in the art could extend the gray scale values to be 12 bits, 16 bits or more as needed (e.g. 12 bits=0–4095).

After these average gray scale values are determined for all the segments, the next step is to calculate offset values on the X and Y axes for the ABS sampling window. The offset values are determined as a function of spatial gray scale distribution within the segments.

In FIG. 6, the ROI 14 was divided into four equal segments. Accordingly, the equations used by the presently preferred method are shown in equations (1) and (2) below.

$$Xoff=(ROISize/2)-(ROISize*(Q2\%GS+Q4\%GS)) \quad \text{Equation 1}$$

where:

Xoff=the Xoffset value of the ABS sampling window

ROISize=the total number of pixels across the X axis of the ROI

Q2%GS=the percentage of gray scale distribution within the second segment

Q4%GS=the percentage of gray scale distribution within the fourth segment $$Yoff=(ROISize/2)-(ROISize*(Q3\%GS+Q4\%GS) \quad \text{Equation 2}$$

where:

Yoff=the Y offset value to be applied to the ABS sampling window

ROISize=the total number of pixels across Y axis of the ROI

Q3%GS=the percentage of gray scale distribution within the third segment

Q4%GS=the percentage of gray scale distribution within the fourth segment

To calculate a result for equations 1 and 2, it is first necessary to calculate the percentage of gray scale distribution within a segment. This result is determined using equation 3.

$$Q(n)\%GS=Q(n)\text{Average}GS/\text{SumOf}Q\text{Averages} \quad \text{Equation 3}$$

where:

Q(n)%GS=the percentage of gray scale distribution within a segment n

Q(n)AverageGS=the average gray scale distribution in a segment n

SumOfQAverages=the sum of the average gray scale distribution in all the segments 1 through n When the Xoffset value and the Yoffset value have been determined, the ABS sampling window is then moved according to the offset values. Based on this disclosure it can be seen that equations could also be generated using Q1 to create a functionally equivalent equation.

In the embodiment described in the preceding pages, it is noted that the segments Q1, Q2, Q3 and Q4 in FIG. 6 all meet at a center of the image ROI 14. Accordingly, the Xoffset and Yoffset can be considered to be an offset that is applied from the center of the image ROI 14, or from any point along an edge of the image ROI 14. The result will be the same. The ABS sampling window will be moved correctly.

The size of the ABS sampling window is determined based on the generator kVp value, and the Image Intensifier size and magnification mode. The approximate relationship has been developed in the current invention between the kVp and the imaging of anatomical structures:

$$\text{kVp}=40+(2\times\text{anatomy thickness in cm}) \quad \text{Equation 4.}$$

This approximate relationship has been defined based on the insight implemented in this invention that most anatomical parts have roughly the same cross sectional dimension in the lateral and inline directions. The association is used to create a relationship between the ABS sampling window and the kVp, where the ABS sampling window size is derived by solving the given equation:

$$\text{ABS window diameter(cm)}=(\text{kVp}-40)\div 2 \quad \text{Equation 5.}$$

The ABS sampling window diameter (as projected onto the surface of the image receptor or image intensifier) is also related to the image intensifier size and magnification modes, and so the image intensifier mode must be normalized. This is done by dividing the calculated ABS sampling window diameter from the equation above by the image intensifier viewing diameter for each case.

For example, suppose the kVp is 60 kVp which corresponds to 10 cm of anatomical thickness and therefore the approximate width or height of the anatomy. In addition, the calculated sampling window diameter projected onto the image intensifier is 10 cm or initially 43% of the 23 cm viewing image diameter. Then if a 23 cm image intensifier (or similar image receptor) is operated in 14 cm magnification mode, the sampling window percentage of the full screen is 10/14 or 71 percent. Thus, the ABS sampling diameter should be 71 percent of the current viewing image diameter. It should be realized based upon this disclosure that the constants used in Equations 4 and 5 could be modified depending on the application of the invention or the desired sizing relationship between the ABS window and the kVp.

Since the kVp is being modified by the data found in the ABS sampling window, the range of the diameter must have an upper and lower limit so that the ABS sampling window does not become unstable. For example, if a small anatomical part such as a patient's fingers (e.g. 1 cm thickness) are viewed in the x-ray system, it is possible for the ABS sampling window to become so small as a result of the sizing modification, that the positioning method could actually move the ABS window past the fingers because it does not know where the fingers are in the darkened segment. If the ABS sampling window misses the viewed anatomy, it will only capture non-attenuated x-ray photons, so the image of the fingers will become darker and unusable. The upper limit exists because once a patient's anatomy exceeds a certain percentage of the image size there is no reason to increase the ABS sampling window size because no advantage is gained by increasing the size. For example, if a patient's torso fills the image, increasing the ABS sampling diameter past a certain point does not affect the kVp appreciably.

The upper and lower limits for the diameter percentages can be determined through experimentation. The preferred diameter percentages are a lower limit of about 40 percent and an upper limit of about 70 percent of the image diameter. The diameter limits may vary depending on the image intensifier size, image intensifier magnification modes and the specific x-ray application.

Since the preferred embodiment of the method of the current invention compares the average gray scale within each segment to the sum of gray scale averages for all quadrants, the segments are not required to have the same area or uniform dimensions. This is beneficial when it is necessary to modify the ROI (Region of Interest) due to collimator encroachment.

Figure 7:
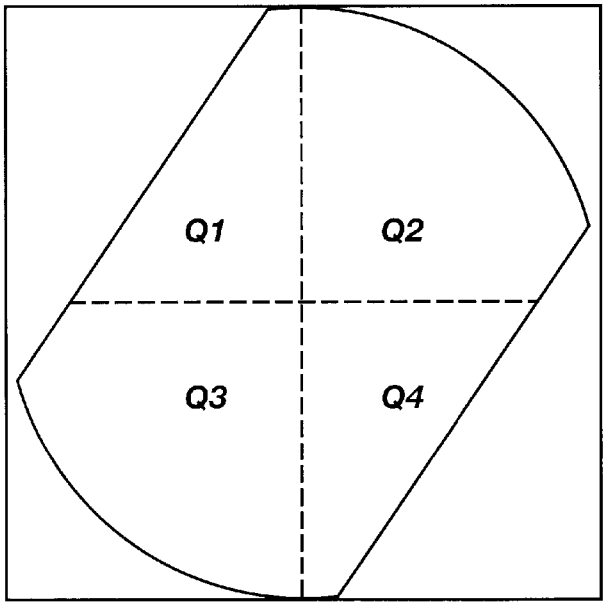
FIG. 7 shows a region of interest divided into quadrants which are clipped based on collimation.

Iris and leaf collimators provide an x-ray barrier to reduce exposure to the patient. As the collimators enter the image area they create dark borders. If the collimator position can be determined, these dark areas should be excluded when collecting average gray scale data. FIG. 7 demonstrates how segment dimensions may be modified due to collimation.

Figure 8:
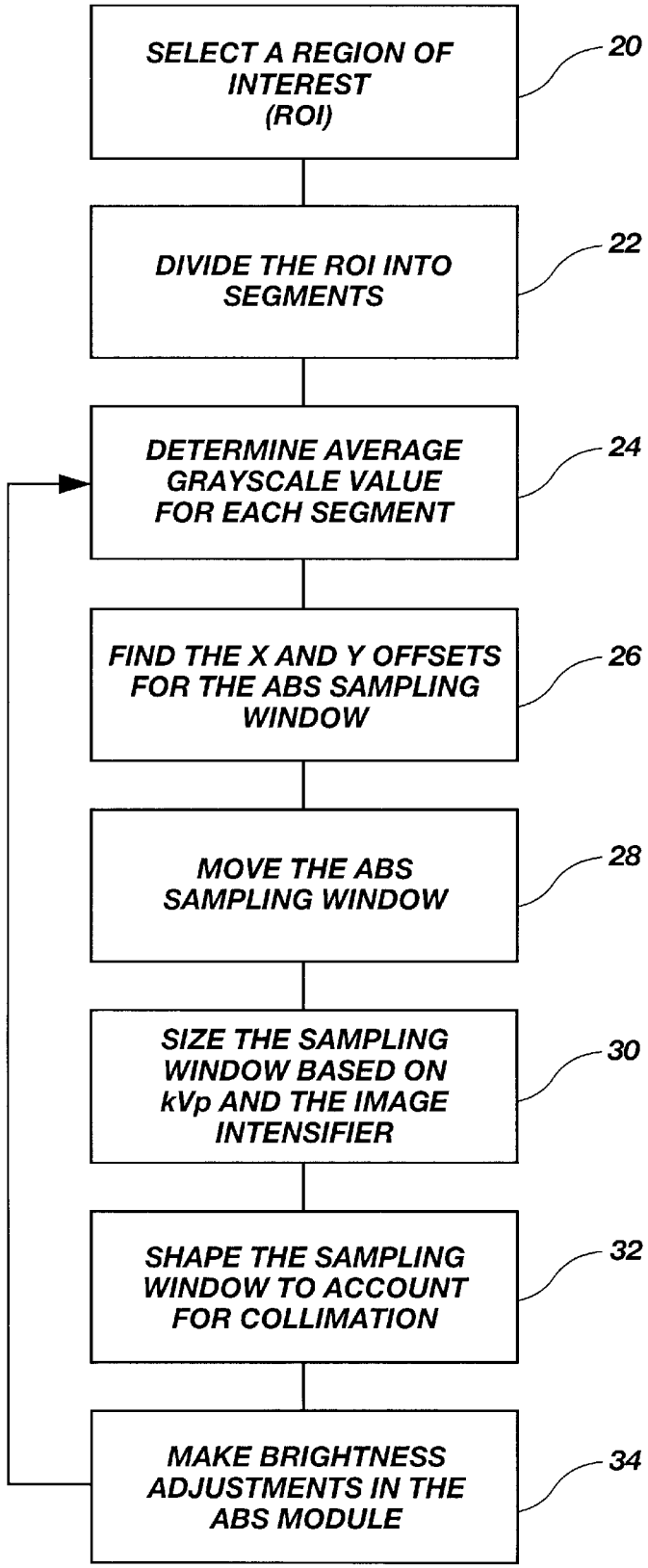
FIG. 8 is a flowchart summarizing the steps in the present preferred embodiment of the present invention.

The steps of the presently preferred embodiment are shown in FIG. 8. The first step 20 is to select an image ROI and a corresponding ABS sampling window. The next step 22 is to divide the image ROI into the necessary number, size and shape of segments. The next step 24 is to determine the average gray scale value for each segment of the image ROI as derived in equation 3. The next step 26 is to find the X and Y axis offsets for the ABS sampling window in accordance with the values determined in equations 1, 2 and 3. The next step 28 is to move the ABS sampling window in accordance with the offsets determined in step 26.

The next step 30 is to size the ABS sampling window based on the value of the generator kVp and the image intensifier size and magnification mode. Then the sampling window is modified to account for the encroachment of the collimators into the sampling area during step 32. Finally, the imaging system makes the necessary measurements in the ABS sampling window to thereby determine an ABS value which is used to adjust the brightness of the image in step 34. The measurements include collecting statistical image pixel data within the ABS sampling window. The information includes the peak and average pixel values provided as inputs to determine the adjustments to be made within the ABS control logic module. Improving the positioning, size and shape of the ABS sampling window provides a better dynamic range of gray scale values in the anatomical images generated by the x-ray system. The adjustments made by the method of the current invention to the ABS sampling window allows better medical and diagnostic information to be gathered from x-ray images.

Figure 9:
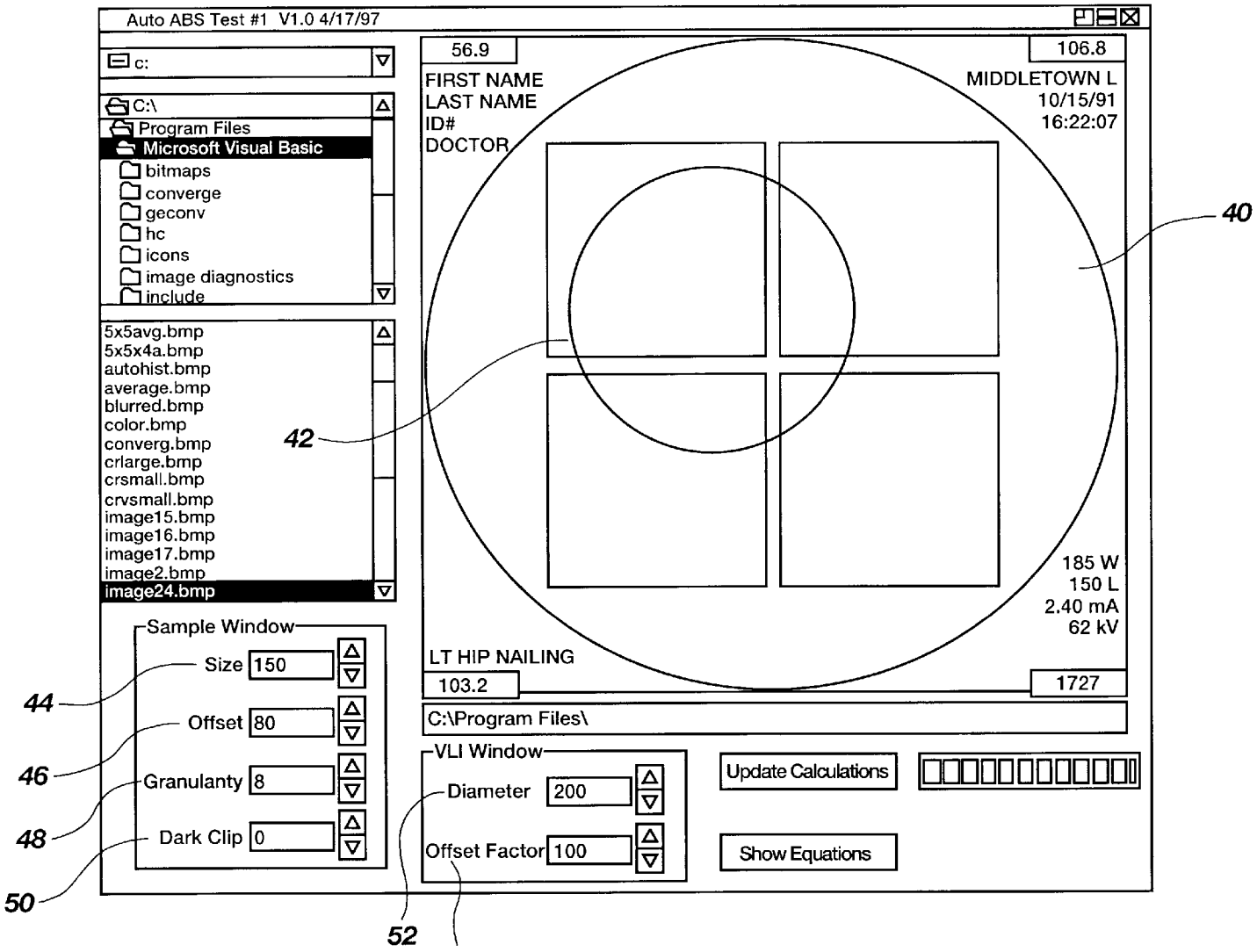
FIG. 9 is provided as an illustration of how the system appears in a modeled test of a clinical image.

FIG. 9 is provided as an illustration of how the system operates in a modeled test on a clinical image. Specifically, the clinical image 40 is shown in a window of a computer display. It should be remembered that the statistics from the ABS sampling window 42 are fed to the ABS control system for closed loop control of the imaging system.

In the demonstration window, there are selectable values in the lower left hand corner of the program window which are entered to model the values normally provided by the sizing and pixel sampling methods. These values include a size 44, an offset 46, a granularity 48, a dark clip 50, a diameter 52 and an offset factor 54.

The size 44 refers to the size of the sample window in pixels. The offset 46 refers to the offsets in pixels that are to be applied to the ABS sampling window. The granularity 48 refers to the pixel sampling level. For example, the sampling can be speeded up if pixels are skipped and only every $2^{nd}$, $4^{th}$, $8^{th}$, etc. pixel in a quadrant or segment is sampled. The dark clip 50 refers to a gray scale threshold value which will be explained later. The diameter 52 refers to the diameter of the ABS sampling window in pixels which is controlled by the kVp and image intensifier size and magnification as described above. The offset factor 54 refers to an amount to reduce the movement of the ABS sampling window from its center origin.

The dark clip 50 referred to above is a threshold value. It is possible for some gray scale values (like orthopedic appliances or non-attenuated x-ray beam) to drastically skew the readings for a segment. A dark clip 50 enables the system to ignore the gray scale values that fall outside the set range of gray scale values. In the preferred embodiment of the invention, the valid range of pixel gray scale values can be set with an upper and a lower bound. For example, a range could be established from 50 to 200. This range establishes a dark clip and a white clip threshold which excludes very light and very dark values. The actual range of clipping values can be determined by various factors such as adaptive spatial sampling, dark mask sampling or direct experimentation.

FIG. 10 is provided as a result page of the calculations for determining the results of equations 1, 2 and 3. The sample numbers given are the result of the analysis of the clinical image 40 in FIG. 9. The results indicate that an Xoffset value of −42 and a Yoffset value of −39 were obtained. Note that the ROISize value is the length of a ROI square side or the ROI circle diameter in pixels.

The Q(n) percent gray scale values for the four segments Q1, Q2, Q3 and Q4 encompass a relatively large range of values. These values are the percentages of light pixels in each segment which make up the whole image in the image ROI. Note that the average gray scale value for Q1 is 56.93, which means the segment is rather dark (on a scale from 0 to 255).

Figure 11:
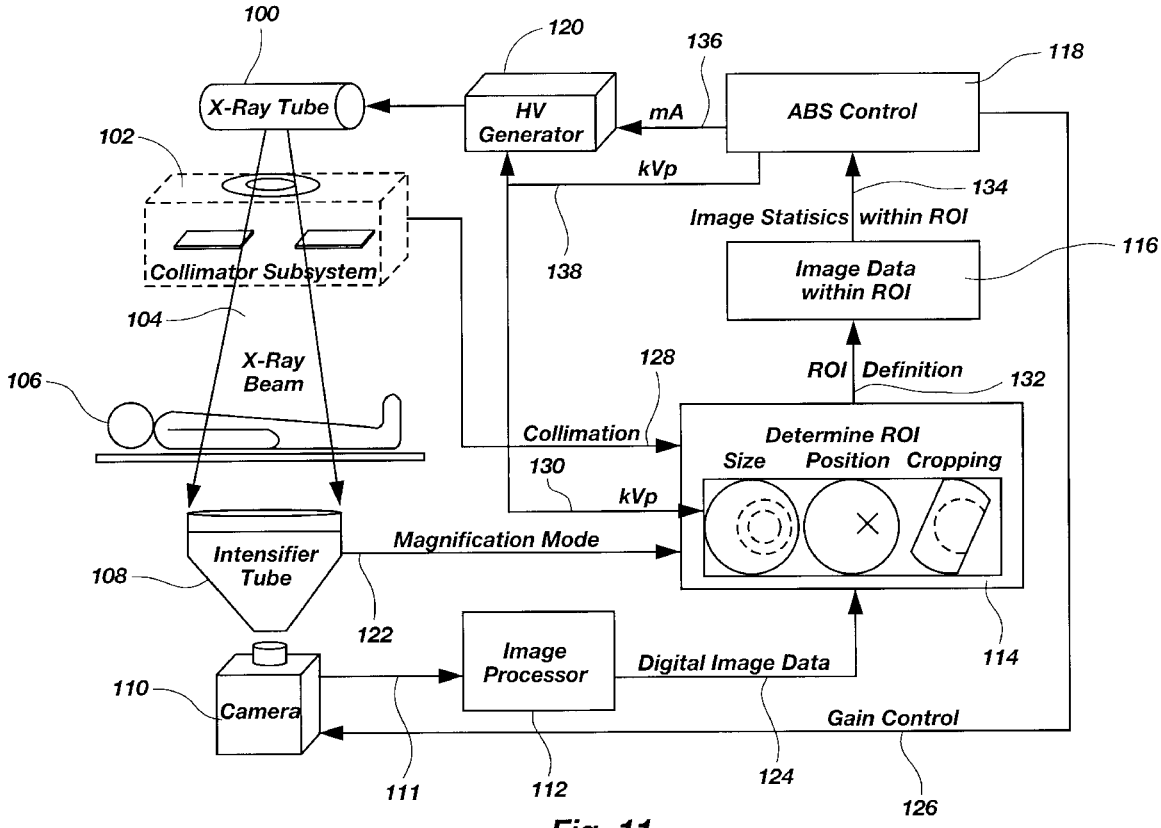
FIG. 11 is a schematic diagram of an x-ray system that has an adjustment unit to modify the ABS sampling window size, position and shape.

FIG. 11 illustrates the current invention as it is used with an x-ray system. An x-ray tube is shown 100 which generates x-rays 104 that pass through an iris and leaf collimator 102. The x-rays 104 then pass through the patient 106 and into the intensifier tube 108 (image intensifier) which in turn generates an image that can be detected by the video camera 110. A video signal 111 becomes the input for the image processor which in turn generates digital image data 124 that is processed by the ABS sampling window processor 114 as described in detail above. The ABS sampling window processor 114 of the current invention determines the size of the ABS sampling window based on the value of the generator kVp 130, and the image intensifier size and magnification mode 122.

The position of the ABS sampling window is calculated in 114 as described above with Equations 1–3. Then finally, the ABS sampling window is clipped if necessary, based on the collimation information 128 from the collimator 102. It should be mentioned that the ABS sampling window processor could be a single application specific chip (ASIC), multiple ASICs or programmed general purpose processors.

The modified ABS sampling window (ROI definition) information 132 is then passed on to an Image Data Analyzer 116 which generates specific statistical information about the image within the ABS sampling window and that statistical data 134 is passed to the ABS control 118. A gain signal 126 is then sent from the ABS control 118 to the camera 110 based on the image statistics received.

Then the ABS control 118 sends a signal for the kVp (kilovolts) 138 and mA (milliamps) 136 to the High Voltage (HV) generator 120 based on the statistical information 134 received to control the system image brightness.

There are also several alternative embodiments of the present invention which should be explored. An alternative embodiment of the invention may provide another criteria to determine the ABS sampling window size. The ratio of the whole image average gray scale versus the quadrant average gray scale may be used to determine the ABS sampling window size. So if the whole image is unusually bright, that might indicate the anatomy within the image is small and the sampling window size should be reduced.

In another embodiment of the invention, a factor for defining ABS window size is based on anatomical selection techniques. If the ABS application knows that the anatomy in the image field is, for example, a lateral wrist, a narrow rectangular sampling window provides more meaningful statistical information than a round sampling window.

The offset 46 (shown in FIG. 9) is also an alternative embodiment. Specifically, the invention can be configured to move the ABS sampling window a smaller distance or a greater distance from the image center than the Xoffset and Yoffset values determines. This can be useful for fine adjustments when the method of the present invention does not automatically achieve an optimum ABS for the image on the monitor.

Another alternative embodiment is to provide a method for dampening the movement of the ABS sampling window. This dampening effect can be obtained by adding temporal averaging to the method. In other words, averaging calculations can be performed for each frame or up to 30 times per second in order to provide dynamic (near real time) compensation.

It is to be understood that the above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. A method for determining the size, position and shape of an automatic brightness system (ABS) sampling window in an x-ray image and adjusting brightness of the image in a closed loop x-ray imaging system, said method comprising the steps of:

(a) determining size of the ABS sampling window, based on a function of a generator kVp value;

(b) determining position of the ABS sampling window based on a spatial gray scale distribution within an image region of interest;

(c) determining geometry of the ABS sampling window based on collimation of x-rays in the system; and (d) adjusting a brightness control of the image in accordance with data obtained from the ABS sampling window as modified in steps (a)–(c), to thereby compensate for the deleterious effects of improper patient positioning, variations in patient size, and rapid changes from torso to extremity imaging.

2. The method as in claim 1 wherein the step of determining the size of the automatic brightness system (ABS) sampling window further comprises the steps of:

finding a diameter for the ABS sampling window in centimeters using a kilovolt potential value from a high voltage generator;

dividing the diameter by the image intensifier mode in centimeters to derive an ABS sampling window percentage in relation to a full image diameter; and setting the ABS sampling window diameter to the ABS sampling window percentage of the full image diameter.

3. The method as in claim 2 wherein the step of finding a diameter for the automatic brightness system (ABS) sampling window in centimeters using a kilovolt potential value from a high voltage generator further comprises, subtracting 40 from the kilovolt potential value and dividing the value by two.

4. The method as in claim 1 wherein the step of determining size of the automatic brightness system (ABS) sampling window based on a function of a generator kVp value further comprises, determining size of the ABS sampling window based on a function of a generator kVp and an image receptor mode.

5. The method as in claim 1 wherein the step of determining the size of the automatic brightness system (ABS) sampling window further comprises determining an intensifier mode based on an image intensifier size, and an image intensifier magnification mode.

6. The method as in claim 1 wherein the step of determining the size of the automatic brightness system (ABS) sampling window further comprises selecting an ABS sampling window size which constrains the maximum and minimum size of a full image viewing diameter.

7. The method as in claim 6 wherein the automatic brightness system (ABS) sampling window is constrained to be between 40 to 70 percent of the full image viewing diameter.

8. The method of claim 1 where the step of determining the shape of the automatic brightness system (ABS) sampling window based on the collimation of x-rays in the system further comprises modifying the sampling window to account for the encroachment of collimators into the ABS sampling window.

9. The method of claim 1 wherein the step of determining the position of the automatic brightness system (ABS) sampling window, further comprises the steps of:

(1) selecting a region of interest within the image being processed;

(2) dividing the region of interest into a plurality of segments; and (3) determining an ABS sampling window position based on gray scale distribution within the image by comparing the proportional gray scale values of the segments.

10. The method as defined in claim 9 wherein the step of selecting a region of interest within the image displayed further comprises the step of generating a circular blanking area within the image, wherein the region of interest is selected from within the circular blanking area.

11. The method as defined in claim 9 wherein the step of selecting a region of interest within the image further comprises the step of establishing an automatic brightness system (ABS) sampling window within the region of interest, wherein statistical gray scale distribution data within the ABS sampling window is utilized to determine proper adjustments to be made to the brightness of the image.

12. The method as defined in claim 9 wherein the step of dividing the region of interest into a plurality of segments further comprises the step of selecting the automatic brightness system (ABS) sampling window to encompass a circular region of the image.

13. The method as defined in claim 12 wherein the step of dividing the image region of interest (ROI) sampling window into quadrants further comprises the step of dividing the image region of interest (ROI) into equally sized quadrants.

14. The method as defined in claim 9 wherein the step of determining an ABS sampling window position based on gray scale distribution within the image by comparing the proportional gray scale values of the segments further comprises the step of moving the automatic brightness system (ABS) sampling window such that measurements of statistical data within the ABS sampling window will enable the system to make adjustments to the brightness control system to obtain an improved image on the monitor.

15. The method as defined in claim 14 wherein the step of moving the automatic brightness system (ABS) sampling window further comprises the step of first determining an X offset value and a Y offset value for the ABS sampling window.

16. The method as defined in claim 15 wherein the step of determining an X offset value and a Y offset value for the automatic brightness system (ABS) sampling window further comprises the steps of:

(1) determining an average gray scale value for each of the segments of the image region of interest (ROI); and (2) determining the X offset value and the Y offset value utilizing the average gray scale values of each of the segments, and the size of the region of interest.

17. The method as defined in claim 16 wherein the step of determining the average gray scale value for each of the segments of the image region of interest (ROI) sampling window further comprises the step of executing the following equation for each of the segments:

$$Q(n)\%GS=Q(n)\text{Average}GS/\text{SumOf}Q\text{Averages}$$

where:

Q(n)%GS=the percentage of gray scale distribution within a segment n,

Q(n)AverageGS=the average gray scale distribution in a segment n,

SumOfQAverages=the sum of the average gray scale distribution in all the segments 1 through n.

18. The method as defined in claim 16 wherein the step of determining the X offset value and the Y offset value utilizing the average gray scale values of each of the four segments further comprises the step of determining the X offset value utilizing the following equation:

$$X\text{off}=(ROI\text{Size}/2)-(ROI\text{Size}\times(Q2\%GS+Q4\%GS))$$

where:

Xoff=the X offset value of the automatic brightness system sampling window,

ROISize=the total number of pixels across the X axis of the region of interest,

Q2%GS=the percentage of gray scale distribution within a second segment,

Q4%GS=the percentage of gray scale distribution within a fourth segment.

19. The method as defined in claim 16 wherein the step of determining the X offset value and the Y offset value utilizing the average gray scale values of each of the four segments further comprises the step of determining the Y offset value utilizing the following equation:

$$Yoff=(ROISize2)-(ROISize*(Q3\%GS+Q4\%GS)$$

where:

Yoff=the Y offset value to be applied to the automatic brightness system sampling window, ROISize=the total number of pixels across Y axis of the region of interest Q3%GS=the percentage of gray scale distribution within a third, segment, Q4%GS=the percentage of gray scale distribution within a fourth segment.

20. The method as defined in claim 16 wherein the method further comprises the step of using a ratio of an average gray scale distribution of the entire automatic brightness system image region of interest (ROI) versus a segment gray scale to thereby adjust the positioning of the ABS sampling window, in accordance with a thickness of a patient's anatomy being x-rayed and displayed on the monitor.

21. The method as defined in claim 15 wherein the method further comprises the step of dampening movement of the automatic brightness system (ABS) sampling window by utilizing temporal averaging.

22. The method as defined in claim 9 wherein the step of determining an ABS sampling window position based on gray scale distribution within the image by comparing the proportional gray scale values of the segments further comprises the step of establishing an upper threshold and a lower threshold for ignoring gray scale values to thereby avoid skewing gray scale distribution values.

23. The method as defined in claim 22 wherein the method further comprises the step of eliminating a portion of the image region of interest (ROI) sampling window from calculations for determining spatial gray scale distribution if part of an x-ray exposure is outside said upper and lower thresholds.

24. The method as defined in claim 9 wherein the step of dividing the image region of interest (ROI) sampling window into a plurality segments further comprises the steps of centering the segments about an origin of the image Region of interest (ROI) sampling window, such that the plurality of segments are not in contact with each other, and are equally spaced about the origin.

25. A method for making automatic adjustments to brightness of an image displayed on a monitor in a closed loop x-ray imaging system, said method comprising the steps of:

(1) selecting a region of interest within the image;

(2) establishing an automatic brightness system (ABS) sampling window within the region of interest;

(3) adjusting a position of the ABS sampling window through measurements of statistical gray scale distribution within the ABS sampling window; and (4) adjusting the brightness of the image in accordance with the gray scale statistics within the ABS sampling window, to thereby compensate for the deleterious effects of improper patient positioning, variations in patient size, and rapid changes from torso to extremity imaging.

26. The method as in claim 25 where in step of adjusting a position of the automatic brightness system (ABS) sampling window further comprises the step of adjusting the position of the automatic brightness (ABS) window based on a spatial gray scale distribution in a segment as compared against at least one other segment which has a spatial gray scale distribution within an image region of interest (ROI).

27. Apparatus for determining the size, position and shape of an automatic brightness system (ABS) sampling window in an x-ray image and making adjustments to brightness of the image in a closed loop x-ray imaging system in response to gray scale data in the adjusted ABS sampling window, comprising:

a position processor coupled to the x-ray imaging system to position the ABS sampling window in the x-ray image received from the x-ray imaging system, based on a spatial gray scale distribution wherein said selected segment has a desirable statistical gray scale distribution within the region of interest;

a size processor coupled to the position processor, to determine the size of the ABS sampling window based on a function of a generator kVp value;

a shape processor coupled to the sizing processor, to determine the shape of the ABS sampling window based on x-ray collimation in the x-ray imaging system;

a statistical processor coupled to the shape processor to receive the ABS sampling window data and to generate statistical information based on ABS sampling window data; and an automatic brightness control coupled to the statistical processor to adjust brightness of the image in accordance with statistical information obtained from the statistical processor regarding the modified ABS sampling window to thereby compensate for the deleterious effects of improper patient positioning, variations in patient size, and rapid changes from torso to extremity imaging.

* * * * *